US006910542B1

(12) United States Patent
Walter

(10) Patent No.: US 6,910,542 B1
(45) Date of Patent: Jun. 28, 2005

(54) ACOUSTIC FLOW PULSING APPARATUS AND METHOD FOR DRILL STRING

(75) Inventor: Bruno Walter, North Vancouver (CA)

(73) Assignee: Lewal Drilling Ltd., St. Albert (CA)

( * ) Notice: Subject to any disclaimer, the term of this patent is extended or adjusted under 35 U.S.C. 154(b) by 32 days.

(21) Appl. No.: 10/614,258

(22) Filed: Jul. 8, 2003

Related U.S. Application Data

(63) Continuation of application No. PCT/CA02/00020, filed on Jan. 9, 2002.

(30) Foreign Application Priority Data

Jan. 9, 2001 (CA) ..... 2331021
Aug. 13, 2001 (CA) ..... 2354994

(51) Int. Cl.[7] ..... E21B 7/24
(52) U.S. Cl. ..... 175/56; 175/93; 175/1
(58) Field of Search ..... 175/24, 25, 26, 175/93, 100, 102, 202, 135, 56, 1, 218

(56) References Cited

U.S. PATENT DOCUMENTS

| | | | | |
|---|---|---|---|---|
| 3,507,341 A | | 4/1970 | Basgan | 175/56 |
| 3,908,770 A | * | 9/1975 | Richter et al. | 175/65 |
| 4,518,048 A | * | 5/1985 | Varley | 175/61 |
| 4,817,739 A | * | 4/1989 | Jeter | 175/38 |
| 5,092,411 A | | 3/1992 | Hausherr et al. | |
| 5,459,699 A | | 10/1995 | Walter | 367/142 |
| 5,467,322 A | | 11/1995 | Walter | 367/142 |
| 5,508,975 A | | 4/1996 | Walter | 367/142 |
| 5,519,670 A | | 5/1996 | Walter | 367/142 |
| 5,549,252 A | | 8/1996 | Walter | 241/264 |
| 5,626,016 A | | 5/1997 | Walter | 60/532 |
| 5,950,736 A | * | 9/1999 | Goldstein | 175/1 |
| 6,050,349 A | * | 4/2000 | Rountree et al. | 175/40 |
| 6,219,301 B1 | * | 4/2001 | Moriarty | 367/84 |
| 6,289,998 B1 | * | 9/2001 | Krueger et al. | 175/25 |
| 6,388,577 B1 | * | 5/2002 | Carstensen | 340/854.3 |

FOREIGN PATENT DOCUMENTS

| | | |
|---|---|---|
| DE | 25 41 795 | 3/1977 |
| EP | 0 406 492 | 1/1991 |
| GB | 2 345 931 | 7/2000 |
| OA | 6 683 | 5/1982 |

* cited by examiner

*Primary Examiner*—Frank Tsay
(74) *Attorney, Agent, or Firm*—Oven Wiggs Green & Mutala

(57) ABSTRACT

An underground drilling method and apparatus generates intense pressure pulses at a location at the surface. The pressure pulses propagate down through a drill string to a drill bit. The pulses may be generated by creating water hammer in flowing drilling mud. Intensity of the acoustic pulses is increased in the bit nozzles. Vigorous pulsing of the fluid exiting the bit nozzles results in better cleaning of the hole bottom and faster drilling. The pulses may be used to drive the operation of various down hole tools. One type of tool has multiple pistons arranged in series. High pressure pulses move the pistons to generate strong mechanical vibration in the drill string. Vibration of the drill string may also reduce the friction between the drill string and the hole, resulting in lower torque requirements.

25 Claims, 16 Drawing Sheets

ACOUSTIC FLOW PULSING APPARATUS AND METHOD FOR DRILL STRING

CROSS-REFERENCE TO RELATED APPLICATIONS

This is a continuation of PCT/CA02/00020 filed 9 Jan. 2002 entitled PRESSURE PULSING APPARATUS AT SURFACE AND METHOD FOR DRILLING, which designates the United States of America and which is hereby incorporated herein by reference. This application is related to and claims the benefit of the filing dates of Canadian patent application No. 2,331,021 filed on 9 Jan., 2001 and Canadian patent application No. 2,354,994 filed on 13 Aug. 2001.

FILED OF THE INVENTION

This invention relates to underground drilling. In particular, the invention relates to underground drilling methods which involve the creation of acoustic pulses in drilling fluid, the use of such pulses to operate downhole tools, and the use of such pulses to increase drilling rates. The invention also relates to apparatus adapted to practice the methods of the invention.

BACKGROUND

Deep wells such as oil and gas wells are typically drilled by rotary drilling methods. Some such methods are described in Walter, U.S. Pat. No. 4,979,577. Apparatus for rotary drilling typically comprises a suitably constructed derrick. A drill string having a drill bit at its lower end is gripped and turned by a kelly on a rotary table.

During the course of drilling operations, drilling fluid, often called drilling mud, is pumped downwardly through the hollow drill string. The drilling fluid exits the drill string at the drill bit and flows upwardly along the well bore to the surface. The drilling fluid carries away cuttings, such as rock chips.

The drill string is typically suspended from a block and hook arrangement on the derrick. The drill string, comprises a drill pipe, drill collars and may comprise drilling tools, such as reamers and shock tools, with the drill bit being located at the extreme bottom end.

Drilling a deep underground well is an extremely expensive operation. Great cost savings can be achieved if the drilling process can be made more rapid. A large number of factors affect the penetration rate that can be achieved in drilling a well.

Around the late 1940s, it was discovered that drilling efficiency could be improved by equipping the openings in drill bits, which allow escape of drilling fluid with nozzles. The nozzles provide high velocity jets of drilling fluid at the drill bit. This innovation resulted in a dramatic increase in achievable drilling rates. Today, almost all drill bits are equipped with high velocity nozzles to take advantage of this increased efficiency. It is worthwhile to note that between 45–65% of all hydraulic power output from a mud pump is typically used to accelerate the drilling mud in the drill bit nozzles.

The flow rate of drilling fluid affects penetration rates. Rock drill bits drill by forming successive small craters in a rock face as individual drill bit teeth contact the rock face. Once a drill bit tooth has formed a crater, rock chips must be removed from the crater. The amount of drilling fluid necessary to effect proper chip removal depends upon the type of rock formation being drilled and the shape of the crater produced by the drill bit teeth. Maintaining an appropriate flow of drilling fluid is important for maintaining a high penetration rate.

The weight on the drill bit also has a very significant effect on drilling penetration rates. If adequate cleaning of rock chips from the rock face is effected, doubling of the drill bit weight will roughly double the drilling penetration rate (i.e. drilling/penetration rate is typically directly proportional to weight on the drill bit). However, if inadequate cleaning takes place, further increases in the drill bit weight do not cause corresponding increases in penetration rate because rock chips not cleared away are being reground, thus wasting energy. If this situation occurs, one solution is to increase pressure and flow of the drilling fluid in an attempt to effect better clearing of rock chips from the vicinity of the drill bit.

Further information on rotary drilling and penetration rate may be found in standard texts on the subject, such as Preston L. Moore's *Drilling Practices Manual*, published by PennWell Publishing Company (Tulsa, Okla.).

Downhole vibrating tools known as mud hammers have been developed in an effort to increase drilling penetration rates. A typical mud hammer comprises a striker hammer which is caused to repeatedly apply sharp blows to an anvil. The sharp blows are transmitted, through the drill bit to the teeth of the drill bit. This has been found to increase drilling penetration rates. Mud hammers are expensive to operate as drill bit life is significantly reduced by the use of a mud hammer.

In another effort to increase drilling penetration rates of drill strings has yielded various downhole devices which exploit the water hammer effect to create pulsations in the flow of drilling mud. Such devices tend to enhance the hydraulic action of the drilling fluid. Their use has a positive effect on rock chip removal and, consequently, drilling penetration rates. Another effect of these devices is to induce vibrations in the drill string, more specifically in the drill bit itself. This too has a positive effect on drilling penetration rates. Examples of such devices can be found in U.S. Pat. No. 4,819,745 (Walter), U.S. Pat. No. 4,830,122 (Walter), U.S. Pat. No. 4,979,577 (Walter), U.S. Pat. No. 5,009,272 (Walter) and U.S. Pat. No. 5,190,114 (Walter).

While the devices described in these patents have proven to be effective at increasing drilling penetration rates they have a number of disadvantages which has prevented their widespread adoption. It is difficult to design such a tool which will operate reliably under the constantly changing properties of drilling mud and the constantly increasing hydrostatic pressure at downhole locations. This problem is exacerbated by the small space within which downhole tools must fit. In many drilling situations the downhole tools have an outside diameter of only 4¾ inches. Space constraints impose onerous constraints on the design of such tools. Other problems with these devices include:

- Downhole conditions are harsh. Operating parts of these tools may not withstand downhole operating conditions for extended periods of time.
- Operating parameters cannot be adjusted while drilling is ongoing. This makes it difficult to optimize the performance of these tools.
- It is not possible to switch these tools on or off while drilling. This makes it difficult to ascertain the effectiveness of the tools since there is a significant variation in drilling penetration rates from well-to-well even if all drilling parameters are kept constant.
- During drilling, these tools are only accessible for repair when they are brought to the surface.

Despite the significant progress that has been made in underground drilling technology over the past century there remains a need for drilling methods and apparatus which provide increased drilling penetration rates. This need is Any significant increase

SUMMARY OF THE INVENTION

This invention provides methods for underground drilling which involve generating high intensity pressure pulses at or near the surface and then allowing those pulses to propagate in drilling mud down a drill string. The pulses may cause fluctuations in the flow of drilling mud exiting nozzles in a drill bit.

The invention also provides apparatus for producing high intensity pulses. The apparatus includes a valve which can suddenly substantially block a conduit in which drilling mud is flowing, thereby creating a water hammer in the flowing drilling mud. In one embodiment of the invention a partial flow from the same mud pump that is used to pump drilling mud down a drill string is diverted into a pulse generating circuit. The pulse generating circuit includes a conduit through which drilling mud can flow and a flow interrupter valve downstream in the conduit. The apparatus may direct drilling mud exiting the flow interrupter valve may to a mud tank or may comprise a jet pump, or other apparatus in the main mud conduit which causes a reduced pressure at a location in the main mud conduit where the diverted drilling mud is reintroduced into the main mud conduit. The apparatus includes a valve controller which operates the flow interrupter valve on a periodic basis.

Another aspect of the invention provides downhole tools that are operated by pressure pulses propagating down a drill string according to the invention.

Further aspects and advantages of the invention are described below and shown in the accompanying drawings.

BRIEF DESCRIPTION OF THE DRAWINGS

In drawings which illustrate various non limiting embodiments of the invention.

DETAILED DESCRIPTION

As required, detailed embodiments of the present invention are disclosed herein. However, it is to be understood that the disclosed embodiments are merely exemplary of the invention, which may be embodied in various forms. Therefore, specific structural and functional details disclosed herein are not to be determined as limiting, but merely as a basis for the claims and a representative basis for teaching one skilled in the art to variously employ the present invention in virtually any appropriately detailed structure.

This invention provides methods for generating acoustic pulses at the surface and conveying such pulses downhole to downhole tools and/or a drill bit. In preferred embodiments of the invention, acoustic pulses are generated by interrupting the flow of drilling mud in a conduit and thereby causing water hammer in the conduit.

Figure 1A:
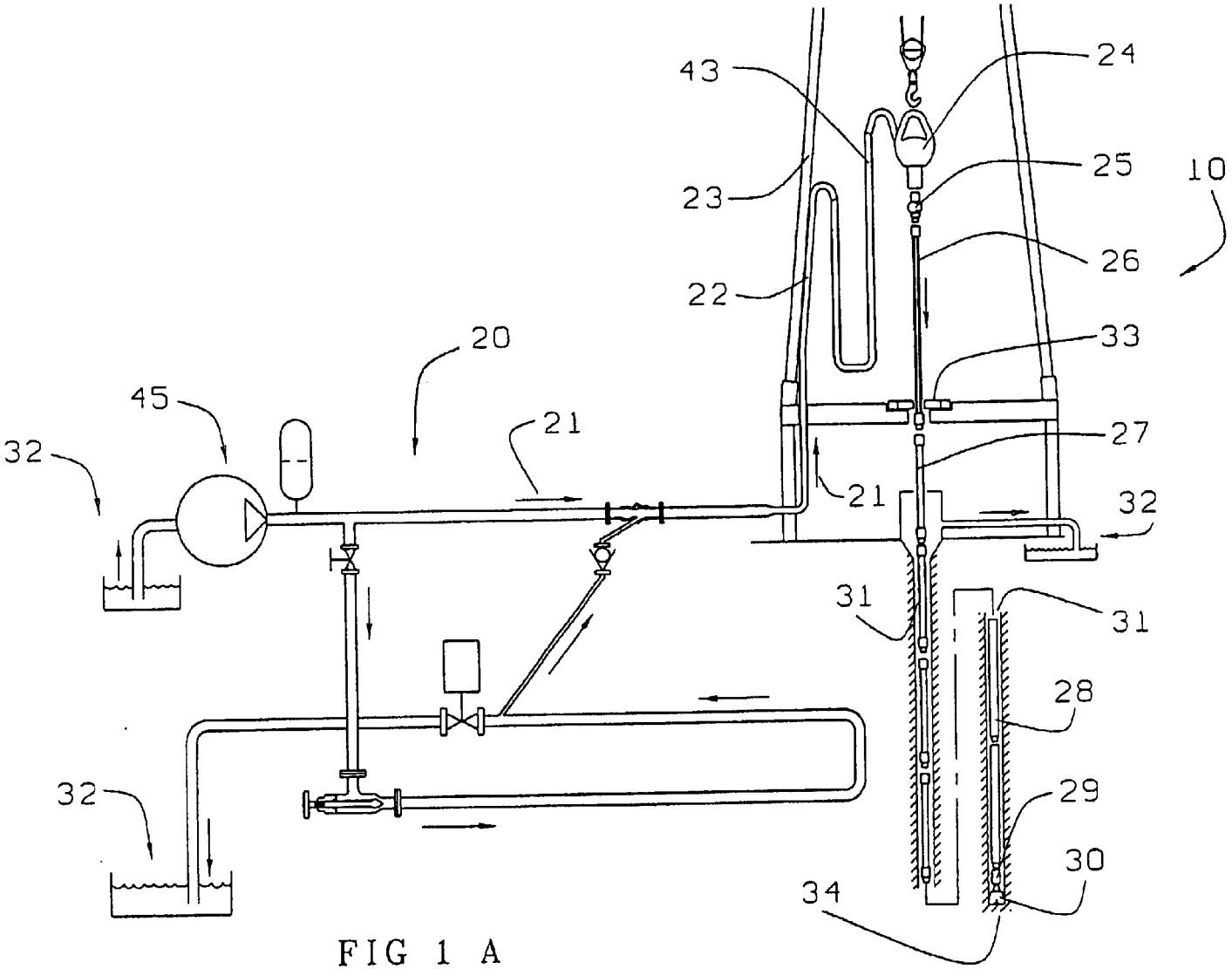
FIG. 1A is a schematic view of a typical classic rotary drilling method apparatus, with a surface acoustic pulse generator (SAP generator) pursuant to one embodiment of the invention.
Figure 1B:
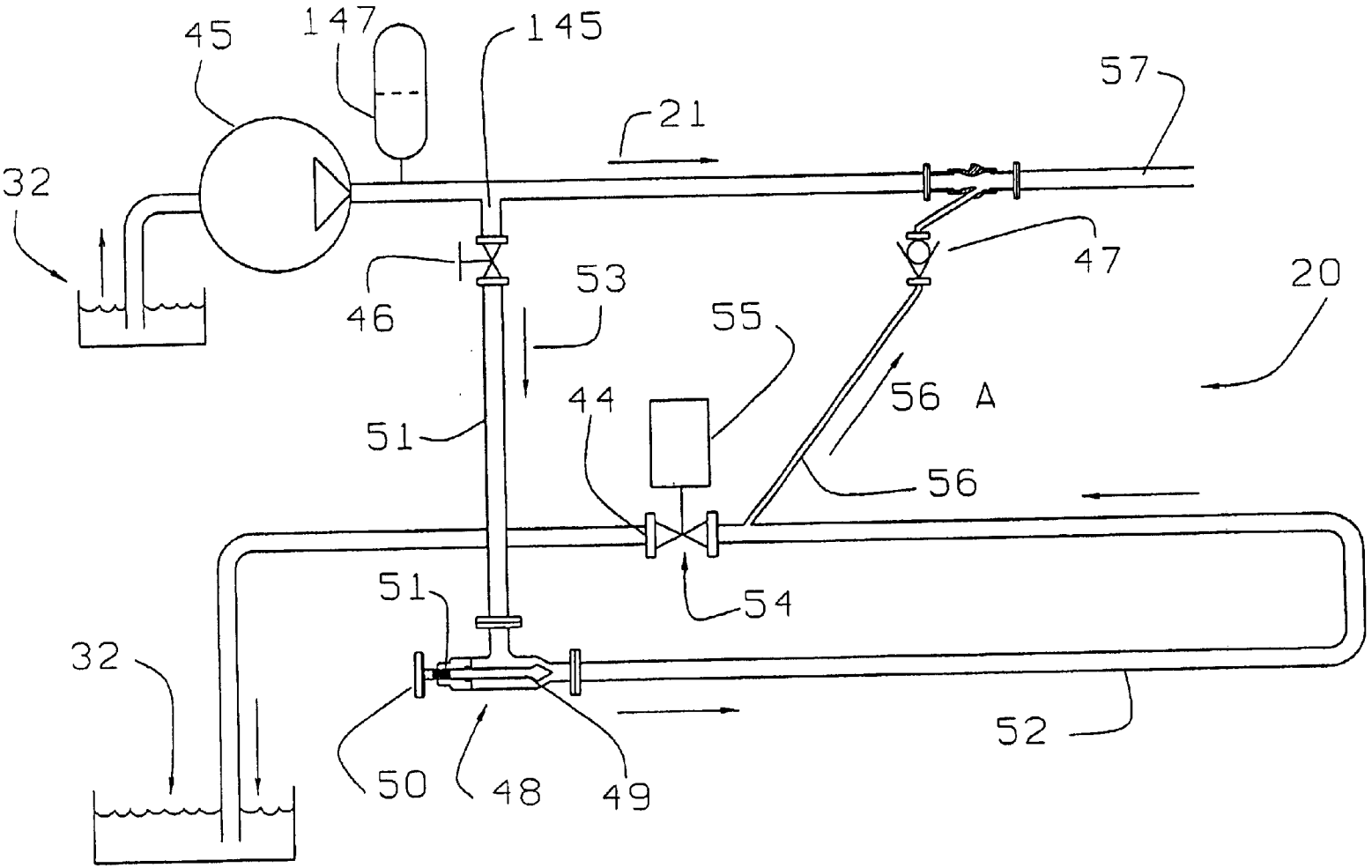
FIG. 1B is an enlarged schematic diagram of the SAP generator of FIG. 1A.

FIG. 1A is a schematic view of a typical rotary drilling apparatus 10 which has been modified by the addition of a surface acoustic pulse generator (SAP generator) 20 according to the invention. FIG. 1B is a detailed schematic view of SAP generator 20. Rotary drilling apparatus 20 comprises a mud pump 45 which pumps drilling mud 21 from a mud tank 32 into a stand pipe 22. Pump 45 typically has a relatively high capacity and supplies mud 21 under significant pressure. The pressure within stand pipe 22 might be, for example, 2,500 psi. Stand pipe 22 delivers mud to the drill string in any suitable way.

In the illustrated embodiment, stand pipe 22, is fastened to a derrick 23, located on a surface of an area to be drilled. A flexible hose 43 (made for example of reinforced rubber) carries the flow of drilling mud 21 from stand pipe 22 into a swivel 24, which is suspended from derrick 23 by a hook. From swivel 24, drilling mud 21 enters a drilling pipe 27 by passing through a kelly cock 25 and then a kelly 26. Drilling mud 21 is conveyed to a drill bit 30 by way of a number of vertically successive drill collars 28, and a bit sub 29. The drilling fluid exits bit 30 through a number of openings. Drilling mud 21 then returns to the surface through the annular well bore 31 surrounding the drill string. At the surface the mud is collected and returned to mud tank 32. The mud may be treated to remove cuttings etc. after it is collected.

Kelly 26 is typically rotated by a rotary table 33. The rotation of kelly 26 is imparted to drill pipe 27, successive drill collars 28, bit sub 29 and drill bit 30. In some cases the drill string may be rotated by a top drive (not shown). In such cases a kelly is not needed. As shown in FIG. 1A, SAP generator 20 is preferably installed between mud pump 45 and stand pipe 22.

As shown in detail in FIG. 1B, some of pressurized drilling mud 21 is diverted at a junction 145 into a conduit 52 as indicated by arrow 53. Conduit 52 is preferably made from heavy wall pipe. The amount of drilling mud diverted into conduit 52 can be adjusted by a flow control valve 48. In preferred embodiments of the invention the proportion of drilling mud which is diverted at junction 145 is significantly smaller than the proportion of drilling mud in the main flow which continues past junction 145 into stand pipe 22. In the illustrated embodiment, flow control valve 48 comprises a needle valve. The flow in conduit 52 can be adjusted by turning valve stem 49 with knob 50. Valve stem 49 is in threaded engagement 51 with the housing of flow control valve 48. Therefore, rotation of valve stem 49 causes valve stem 49 to move axially, thereby altering the degree to which valve stem 49 restricts the flow of fluid into conduit 52. Suitable seals are provided to prevent leakage of mud around valve stem 49.

A substantial portion of the drilling mud diverted at junction 145 eventually flows back into mud tank 32 (the two mud tanks 32 illustrated in each of FIGS. 1A and 1B may be different mud tanks but are preferably the same mud tank). SAP generator 20 includes a flow interrupting valve 54 operated by a valve controller 55 which causes valve 54 to periodically at least substantially block the flow of drilling mud 21 out of conduit 52. A currently preferred embodiment of interrupter valve controller 55 according to this invention is described below with reference to FIGS. 5A through 5C.

Valve controller 55 may comprise any of a wide variety of valve control means. By way of example only, possible valve control means include:

- electrically operated valve actuators driven by electrical or electronic controllers;
- hydraulic or pneumatic control circuits;
- valve members in valve 54 actuated by flow of mud through valve 54; and,
- mechanical valve operating mechanisms comprising cams, reciprocating members, oscillating members, or the like which move a valve member in a valve 54 to periodically interrupt the flow of drilling mud through valve 54.

When valve 54 is not blocking the flow of drilling mud, the drilling mud flows through valve 54 and out of port 44. By rapidly blocking the flowing drilling mud in conduit 52, flow interrupting valve 54 generates water hammer pulses which propagate upstream in conduit 52.

A pulse transmission means, which is a conduit 56 in the illustrated embodiment, has one end connected to conduit 52 at a location upstream from interrupter valve 54. Another end of pulse transmission conduit 56 joins main conduit 57, which carries the main flow of drilling mud 21 to stand pipe 22. In preferred embodiments of the invention, a check valve 47 prevents drilling mud from flowing back through pulse transmission conduit 56 into conduit 52. Check valve 47 opens to allow drilling mud to flow through conduit 56 in the direction of arrow 56A only under the high pressure water hammer pulses generated by the sudden closing of valve 54.

Water hammer induced pressure pulses in conduit 52 are transmitted by pulse transmission conduit 56 into main conduit 57 where they continue to propagate downstream into the drill string. As the bore of the drill string is typically smaller than the bore of conduit 57 and other conduits through which the mud passes at the surface, the intensity of the pulses increases as the pulses pass into the smaller diameter bore of the drill string. The pulses may be applied at underground locations to enhance drilling performance as described below. Pulses may also be transmitted upstream toward pump 45. A pulsation dampener 147 may be provided in main line 57 downstream of pump 45 and upstream of pulse transmission conduit 56 to reduce the effect of SAP generator 20 on the operation of pump 45.

A shut off valve 46 and check valve 47 allow users to isolate SAP generator 20 from the main flow of drilling mud 21 while drilling operations are ongoing. By disconnecting SAP generator 20, drilling/penetration rates with and without SAP generator 20 can be compared. Further, the operating parameters of SAP generator 20 can be adjusted during drilling operations to optimize the performance of the drilling rig.

During operation of the apparatus, some drilling mud 21 flows in the direction of arrow 53 through flow control valve 48 into conduit 52 toward interrupter valve 54. Valve controller 55 causes valve 54 to repeatedly open for a time long enough for a flow of drilling mud to be established in conduit 52 and then close relatively suddenly. Each time this sequence of events occurs a water hammer pulse is generated in conduit 52. The sudden closure of interrupter valve 54 causes kinetic energy of the mud flowing in conduit 52 to be converted into a high pressure acoustic pulse. The intensity of the acoustic pulse increases in proportion to the velocity of the mud flow in conduit 52 approximately according to the equation:

$$\Delta p = @ \times Vs \times V \tag{1}$$

where Δp=pressure increase due to water hammer;

@=specific mass of drilling mud;

Vs=velocity of sound in drilling mud; and,

V=velocity of mud flow in conduit 52.

Further details on the mathematics and physical effects of water hammer can be found in various texts on fluid mechanics, including Victor L Streeter and E. Benjamin Wylie's *Fluid Mechanics* (7th edition), McGraw Hill Book Company (1979).

Water hammer pressure pulses resulting from the sudden closures of valve 54 travel upstream from closed valve 54, at the velocity of the speed of sound in the drilling mud inside conduit 52. This pressure pulse also propagates into conduit 56. Check valve 47 opens and allows the pressure pulse to propagate into main flow conduit 57. The pressure pulses travel at the speed of sound in the drilling mud through stand pipe 22 and down through the drill string to drill bit 30. The pressure pulses cause oscillations in the flow of drilling mud exiting through the nozzles of drill bit 30. This enhances cleaning of the bottom of well bore 34 and helps to achieve improved drilling penetration rates.

Figure 2A:
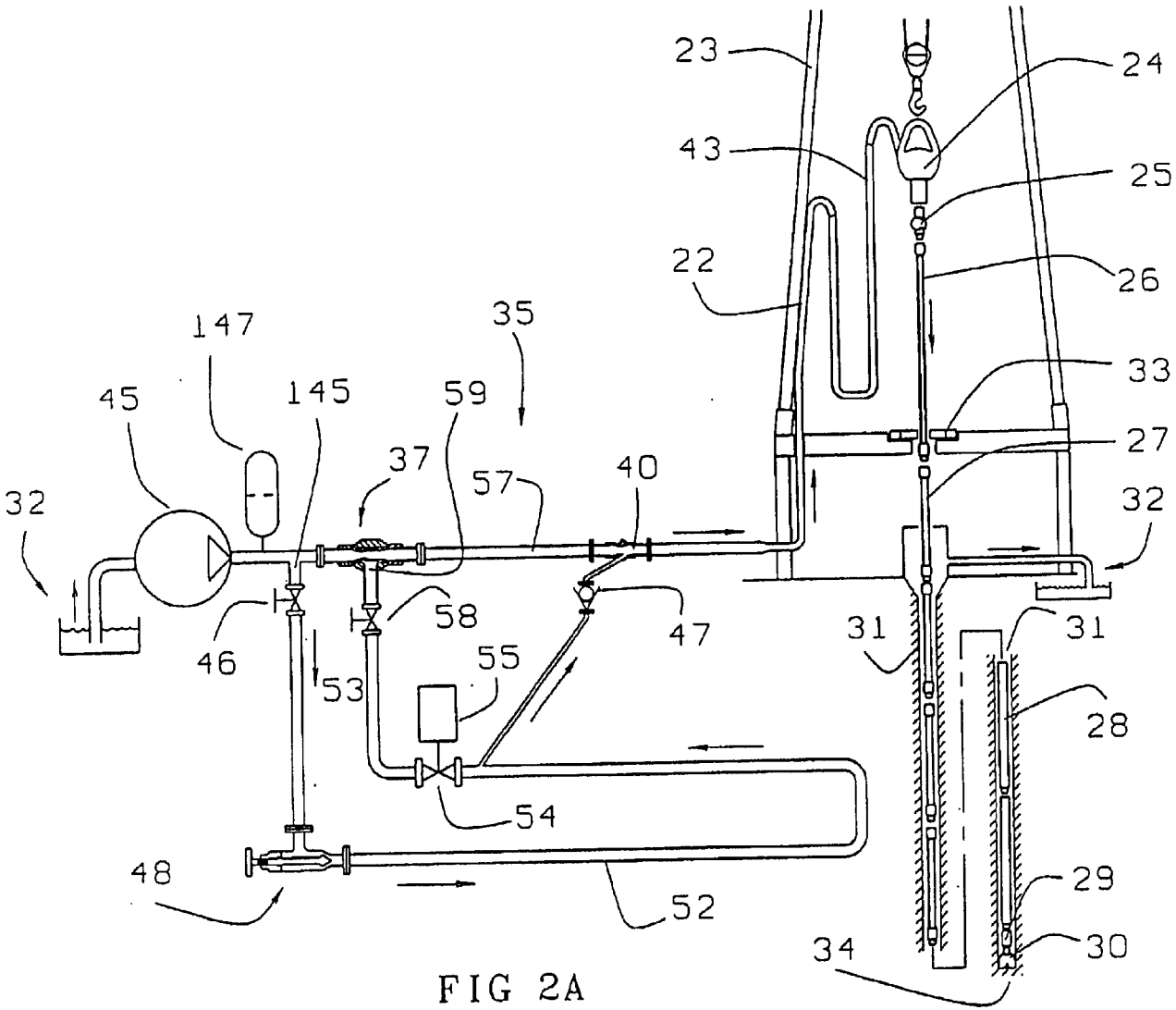
FIG. 2A is a schematic view of a typical classic rotary drilling apparatus, with an SAP generator pursuant to an alternative embodiment of the invention.
Figure 2B:
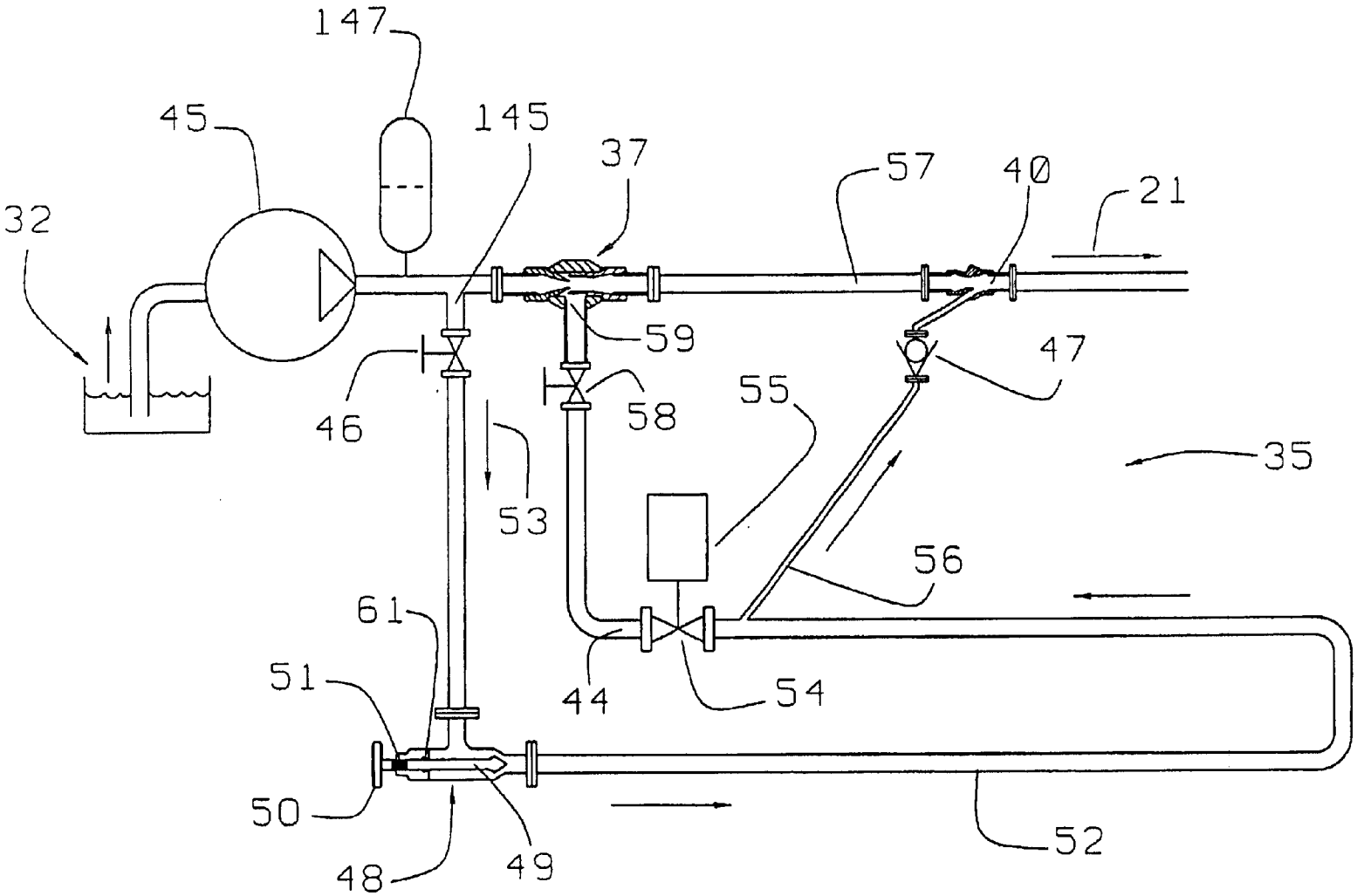
FIG. 2B is an enlarged schematic diagram of the SAP generator of FIG. 2A.

FIG. 2A is a schematic view of a drill rig according to an alternative embodiment of the invention comprising an alternative SAP generator 35. In this embodiment, drilling mud exiting from SAP generator 35 is returned to the main flow of drilling mud in conduit 57. The construction of SAP generator 35 is shown in detail in FIG. 2B. A venturi 37 is provided in main conduit 57. Venturi 37 acts as a jet pump. The pressure within main conduit 57 is reduced at point 59, which is in a volume adjacent to venturi 37. The volume may comprise an annular region surrounding venturi 37. Mud exiting from down stream port 44 of interrupter valve 54 is returned to main partial flow of drilling mud 53 at point 59. The pressure difference between junction 145 at which drilling mud flows into SAP generator 35 and point 59 drives the flow of drilling mud through SAP generator 35. SAP generator 35 functions otherwise in the same manner as the SAP generator 20 described above. High intensity acoustic pulses are delivered into main conduit 57 at point 40. A valve 58 is provided to facilitate isolating SAP generator 35 from main conduit 57. It should be noted that entry of the acoustic pulse can be also incorporated down stream into the venturi arrangement 37.

SAP generator 35 provides the advantages that it permits better monitoring of the drilling mud flow and of mud loss in the well bore. It further allows more flexibility in terms of installation. It should be noted that SAP generator 35 may be constructed so that the acoustic pulses are coupled to main conduit 57 at a point in the venturi arrangement down stream from venturi 37.

Figure 3A:
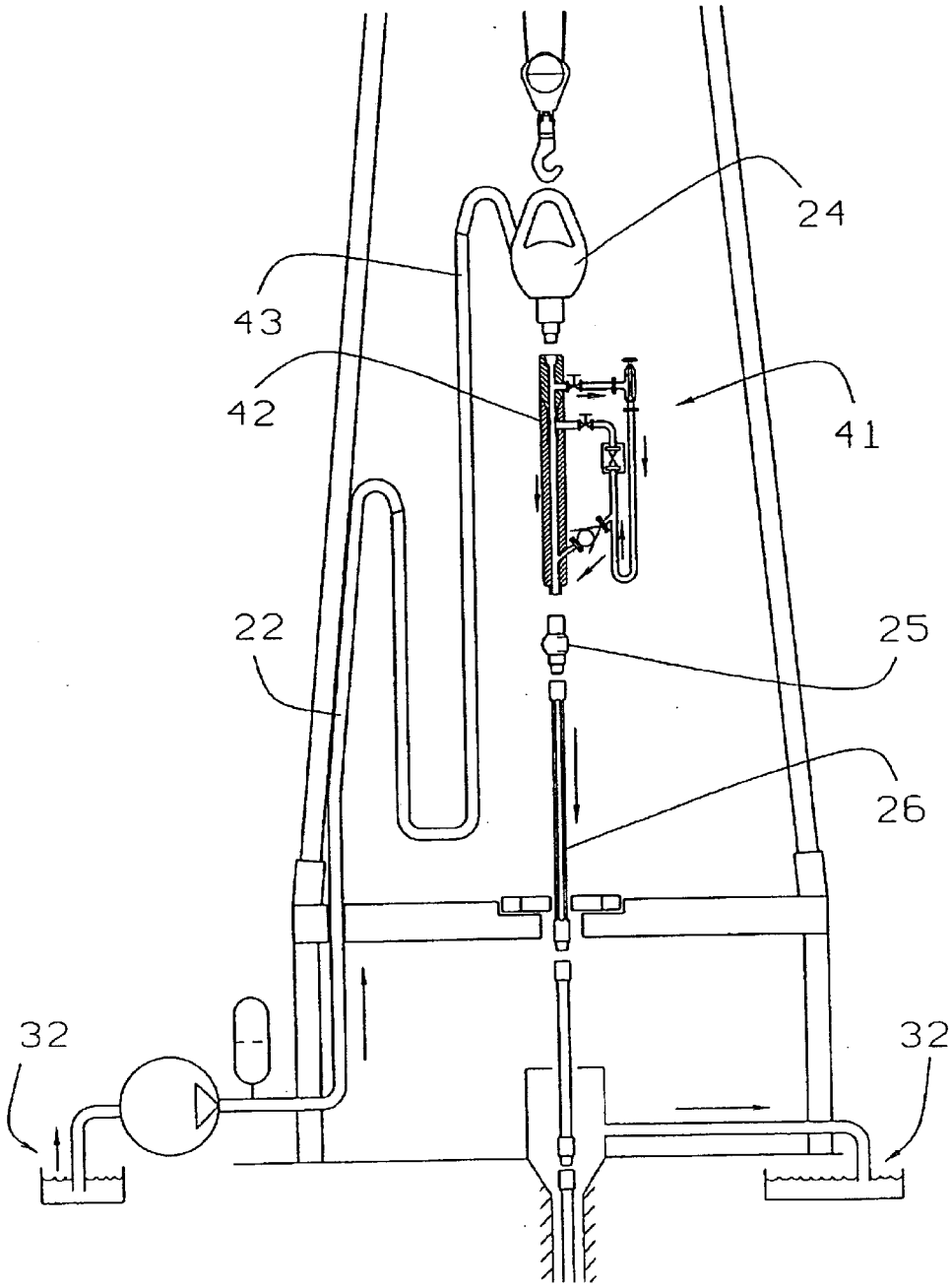
FIG. 3A is a schematic view of a typical classic rotary drilling method apparatus, with an SAP generator pursuant to a further alternative embodiment of the invention.
Figure 3B:
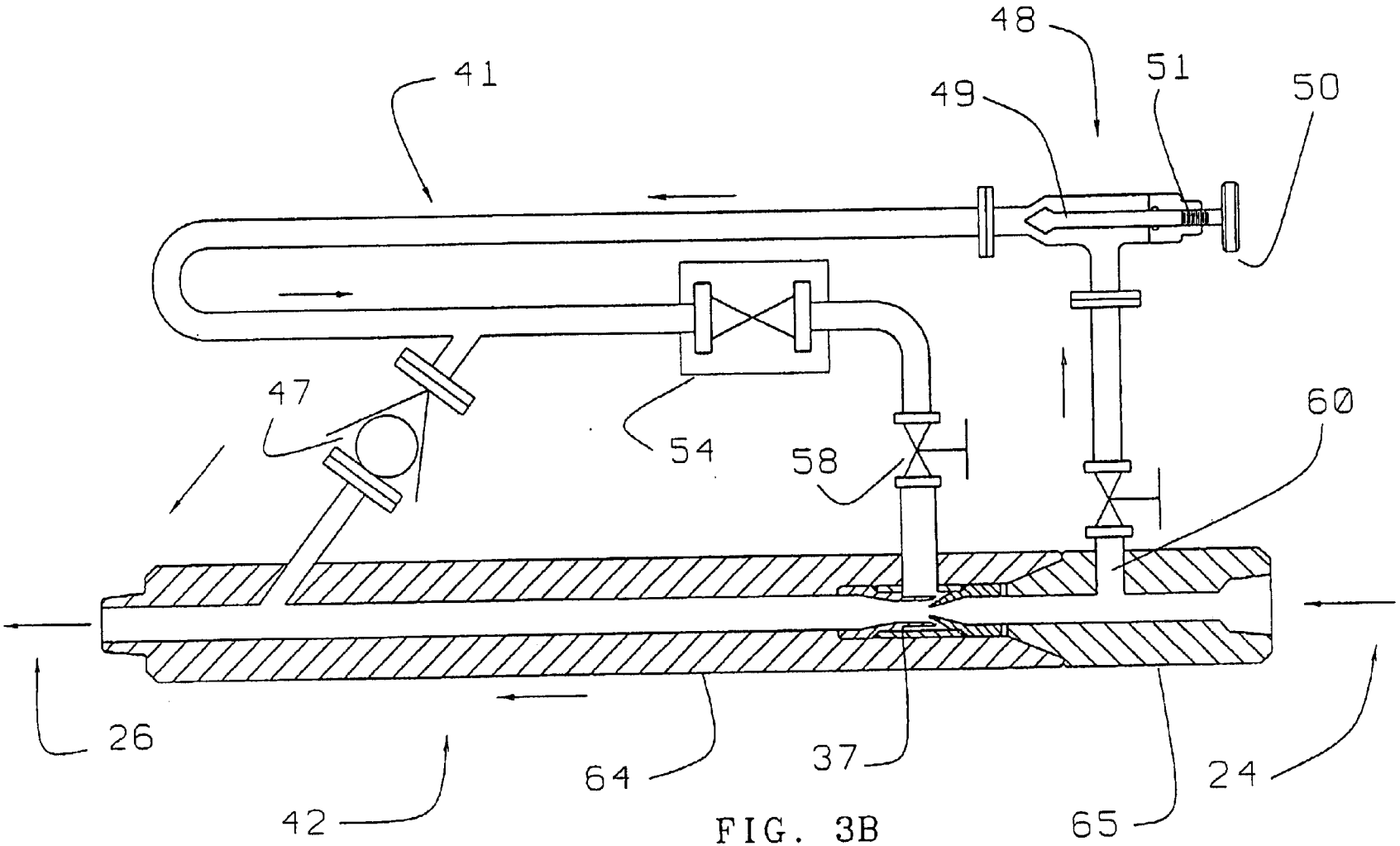
FIG. 3B is an enlarged schematic diagram of the SAP generator of FIG. 3A.

FIGS. 3A and 3B show an alternative SAP generator 41 pursuant to an alternative embodiment of this invention. SAP generating circuit 41 is incorporated into a tool 42, which is placed below swivel 24. Tool 42 is preferably placed above kelly cock 25 and kelly 26. SAP generator 41 operates similarly to SAP generator 35, but introduces pulses directly into the drill string. The pulses do not need to travel through flexible hose 43. All other things being equal, SAP generator 41 should produces pulses of higher intensity at drill bit 30 than the embodiments described above. Venturi arrangement 37 is incorporated into a lower tool body 64. A top tool sub 65 has a conduit 60 that allows a portion of the main flow of drilling mud 21 to enter SAP generator 41. Interrupter valve 54 can be a self regulating valve operated by the water hammer itself as is described in U.S. Pat. No. 5,549,255 (Walter), at FIGS. 8 and 9 which is incorporated herein by reference.

The main advantage of SAP generator 41 is that generated acoustic pulses are inserted directly into the drill string and do not have to travel through rubber hose 43, which may tend to somewhat attenuate the pulses. The main disadvantage is that it is not as easily accessible for servicing and adjustment as SAP 20 or SAP 35.

Figure 4:
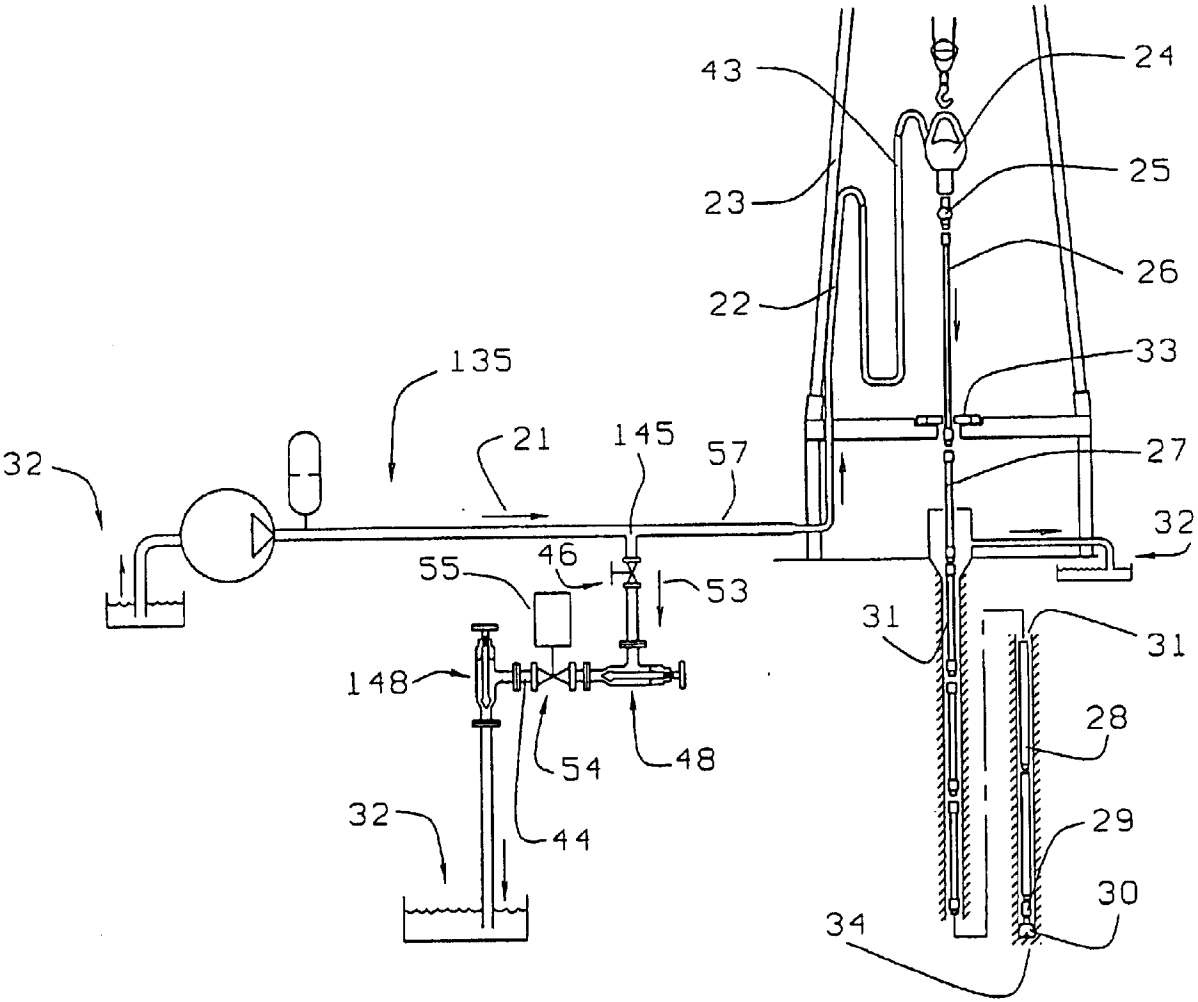
FIG. 4 is a schematic view of a typical classic rotary drilling method apparatus equipped with an SAP generator pursuant to a further alternative embodiment of the invention.

FIG. 4 shows an alternative SAP generator 135 pursuant to an alternative embodiment of this invention. SAP generator 135 is similar to SAP generator 20, save for the fact that it lacks a pulse transmission conduit 56 and check valve 47. Pressure pulses generated by the sudden closure of interrupter valve 54 travel upstream from valve 54 and enter main conduit 57 at junction 145.

SAP generator 135 has an additional flow control valve 148 located between down stream port 44 of interrupter valve 54 and mud tank 32. Second flow control valve 148 allows the back pressure on valve 54 to be adjusted. Depending upon the construction of valve 54, the performance of valve 54 may be adjusted by altering the back pressure.

The SAP generator 135 of FIG. 4 has the advantage of simplicity. Flow control valves 48 and 148 can be adjusted so that just enough drilling mud flows through SAP generator 135 when valve 54 is open to reduce the flow and pressure in main conduit 57 downstream from junction 45.

When valve 54 is opened some drilling mud is diverted through valve 54. A reduced pressure (in some cases zero pressure) pulse propagates downstream through the drilling mud from point 145. The pressure pulse affects the pressure at jet nozzles in bit 30. When valve 54 is subsequently closed, a water hammer is generated upstream from valve 54. When the water hammer reaches point 145 mud is no longer diverted toward valve 54 and all of the mud flowing in the upstream portion of conduit 57 must be carried downstream from point 145 by conduit 57. The pressure at point 145 increases until the mud flowing at locations downstream from point 145 is accelerated. The resulting pressure pulse propagates downstream to affect the pressure at jet nozzles in bit 30.

Figure 5A:
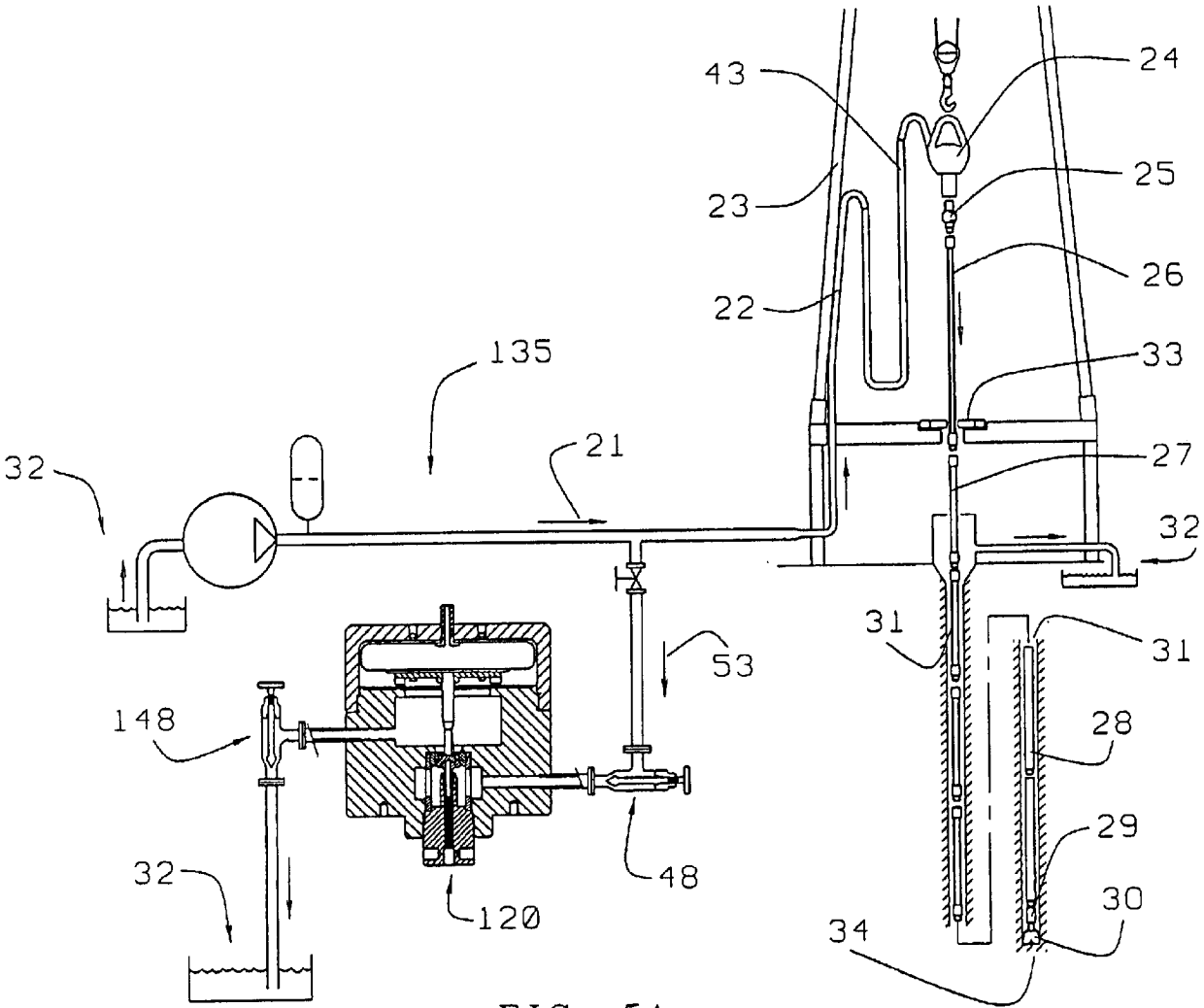
FIG. 5A is a schematic view of the SAP generator of FIG. 4 and a schematic view of a preferred interrupter valve means pursuant to the invention.
Figure 5B:
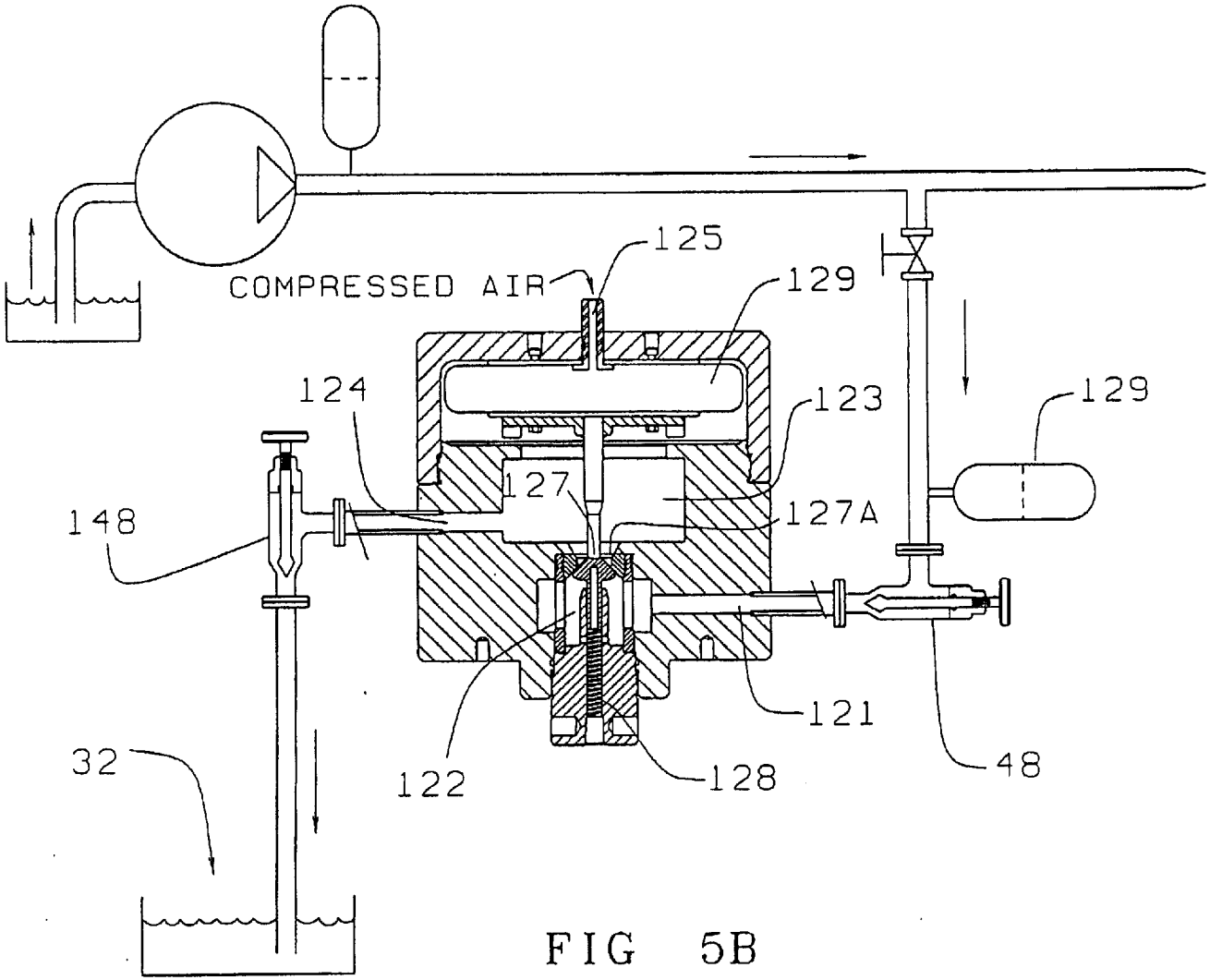
FIG. 5B is an enlarged schematic diagram of the preferred interrupter valve means of FIG. 5A.
Figure 5C:
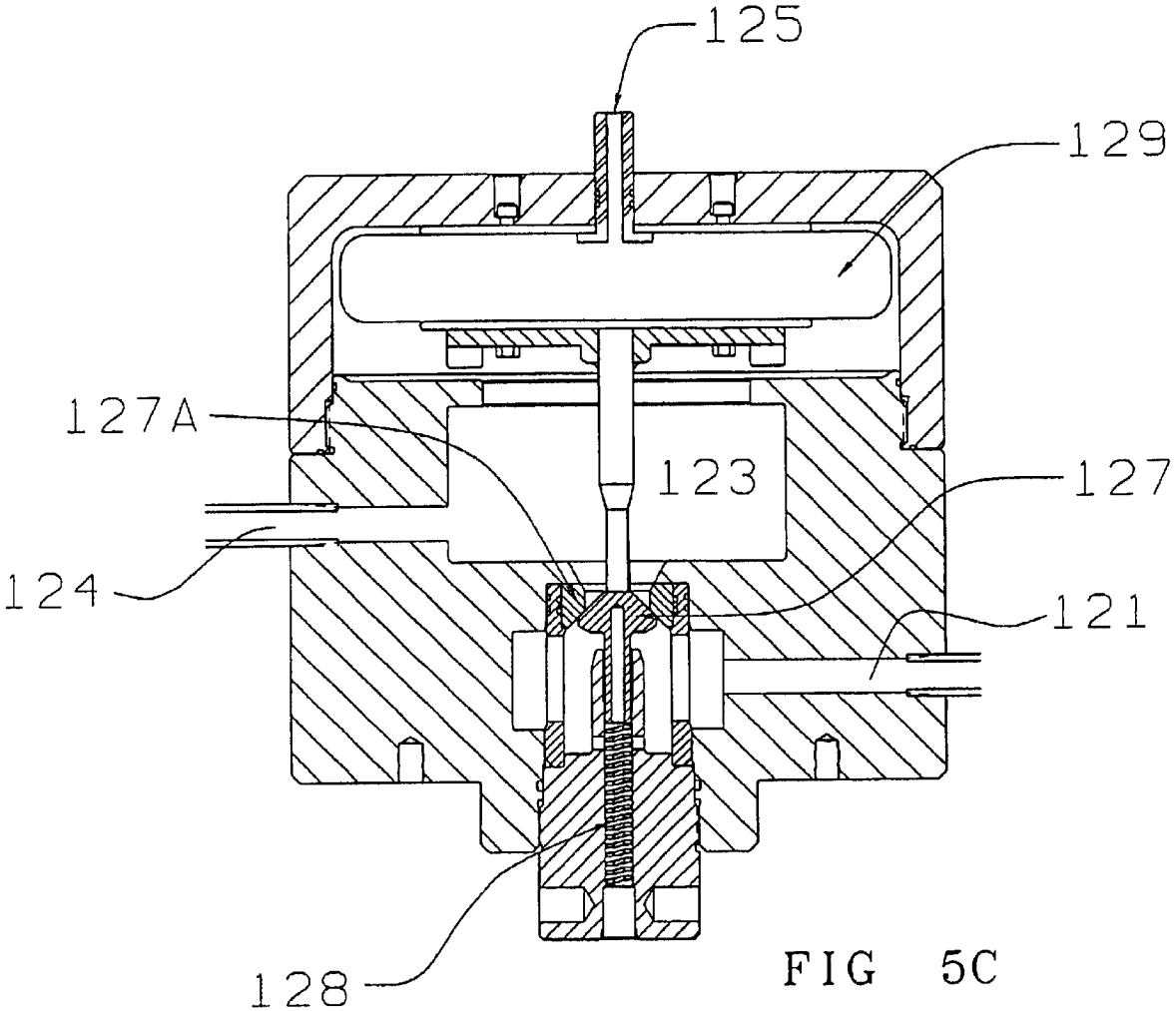
FIG. 5C is a detailed schematic diagram of the preferred interrupter valve means of FIG. 5A.

FIG. 5A shows a drill rig including a SAP generator 135 in which valve 54 and valve controller 55 are provided by an interrupter mechanism 120. Interrupter mechanism 120 can be used to advantage in any of the SAP generators described above. FIGS. 5B and 5C are more detailed views of interrupter mechanism 120.

Interrupter mechanism 120 comprises a valve member 127 which bears against a valve seat 127A. Valve member is biassed into a closed position by a spring 128. An air bladder 129 contains compressed air (which can be supplied through a port 125). Air bladder 129 applies forces to valve member 127 which tend to move valve member 127 into an open position wherein drilling mud can flow from an inlet chamber 122 between valve member 127 and valve seat 127A into an outlet chamber 123. Drilling mud can enter inlet chamber 122 through inlet passage 121. Drilling mud can leave outlet chamber 123 through outlet passage 124.

In operation, compressed air is admitted into bladder 129 until valve member 127 is moved into its open position against the force exerted by spring 128. As soon as this occurs, drilling mud begins to flow from inlet chamber 122 to outlet chamber 123. As drilling mud begins to flow through downstream choke valve 148 a back-pressure is developed. This back pressure, combined with the forces exerted on valve member 127 by flowing fluid cause valve member 127 to move into its closed position. The closure of valve member 127 causes a water hammer pulse to propagate upstream from input chamber 121. Valve member 127 is maintained in its closed position by the pressure pulse (and underlying static pressure). When the pressure pulse reaches main conduit 57, or another place where fluid can flow to relieve pressure, a negative pulse propagates back toward interrupter mechanism 120. Upon arrival of the negative pulse, valve member 127 is pulled open and the cycle repeats itself.

An advantage of interrupter mechanism 120 is that it can be constructed in a robust manner and the frequency of generated pulses can be easily and continuously changed. The operation of mechanism 120 can be adjusted by varying the air pressure in bladder 129 and varying the settings of downstream choke valve 148 and valve 48.

An accumulator 146 may be provided upstream from interrupter mechanism 120 to increase the duration of acoustic pulses. In general this is not required and has the disadvantage of reducing the intensity of the acoustic pulses propagated down the drill string.

In the foregoing embodiments of the invention, intense acoustic pulses are generated at the surface by a SAP generator. The pulses are introduced into the drilling mud which is flowing down the drill string. The pulses propagate down the drill string to the bit. At the bit the pulses cause variations in the mud flow which can increase the efficiency of the drilling operation. The intense acoustic pulses (positive and/or negative) can also be used to actuate downhole tools. The tools can be of simple robust construction. One class of tools that may be actuated by acoustic pulses according to the invention includes tools which impart mechanical vibration to the drill bit. Such tools may suddenly force the drill bit downwardly upon the arrival of a pulse at the tool. In the alternative, such tools may lift a lower portion of the drill string slightly in response to the arrival of a pulse and then drop the lower portion of the drill string after the pulse has passed. Other types of tools such as drilling jars may also be actuated by the acoustic pulses of the invention.

Figure 6:
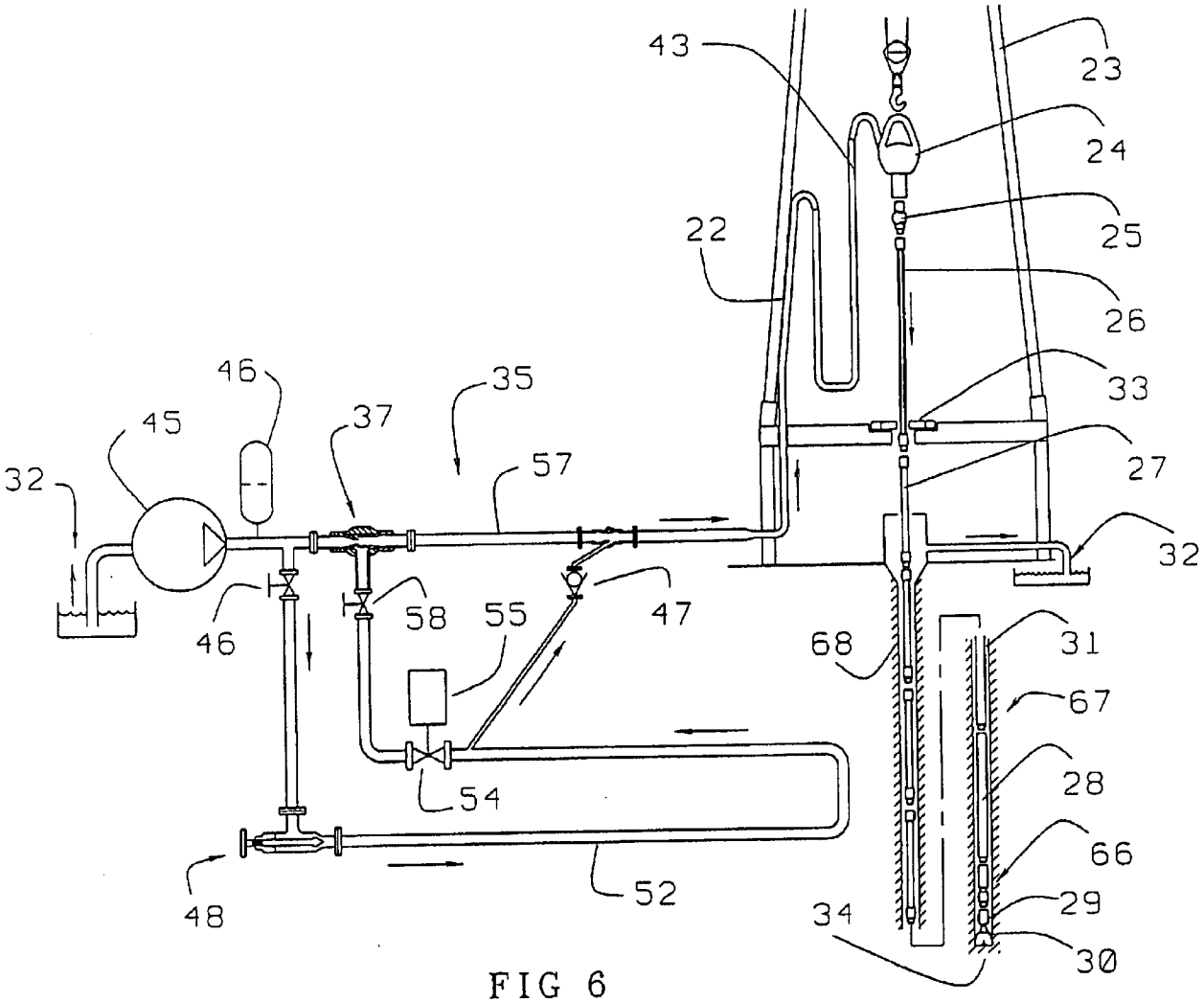
FIG. 6 is a schematic view of drilling apparatus including an acoustic pulse generator and a multiple piston telescopic tool located in a drill string above a drill bit.

FIG. 6 is a schematic view of a rotary drilling apparatus which includes a multiple piston telescopic tool 66 mounted in the drill string above drill bit 30. Pulses generated by SAP generator 35 are conveyed down through the drill string as described above. When the pulses reach multiple piston telescopic tool 66 the tool extends slightly, thereby accelerating the drill bit into the formation being drilled. This embodiment of the invention can significantly vibrate the entire drill string 67, thus reducing friction between drill string 67 and well bore 68. The vibration of drill bit 30 also enhance percussive action of drill bit 30 at the bottom of hole 34, resulting in faster drilling and lower torque requirements.

Figure 7:
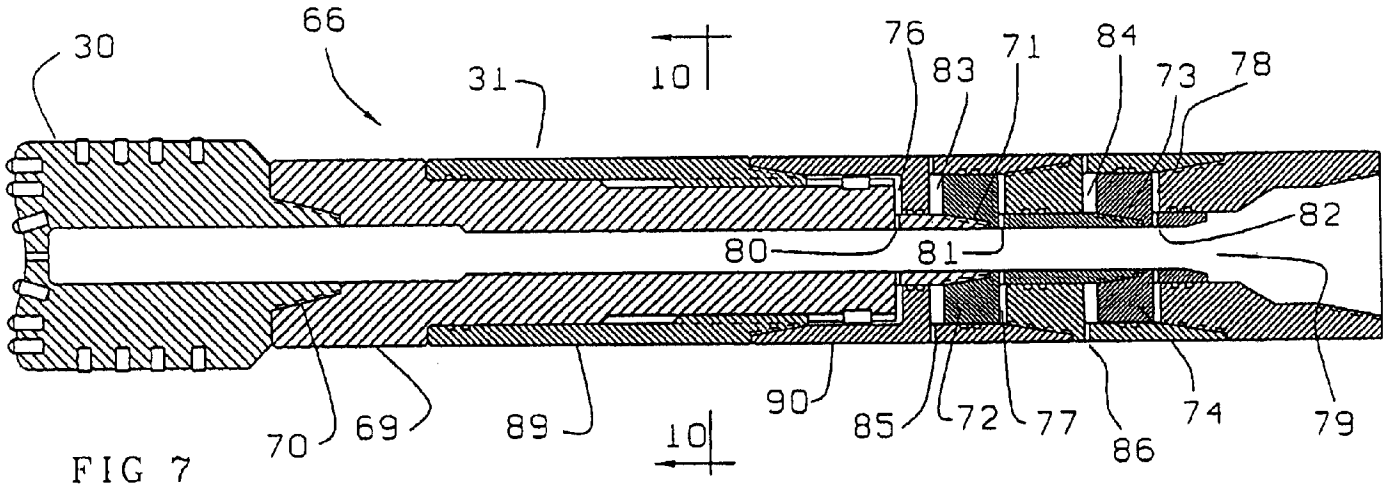
FIG. 7 is a longitudinal sectional view of the down hole telescopic tool of FIG. 6 shown in its "closed" position.
Figure 8:
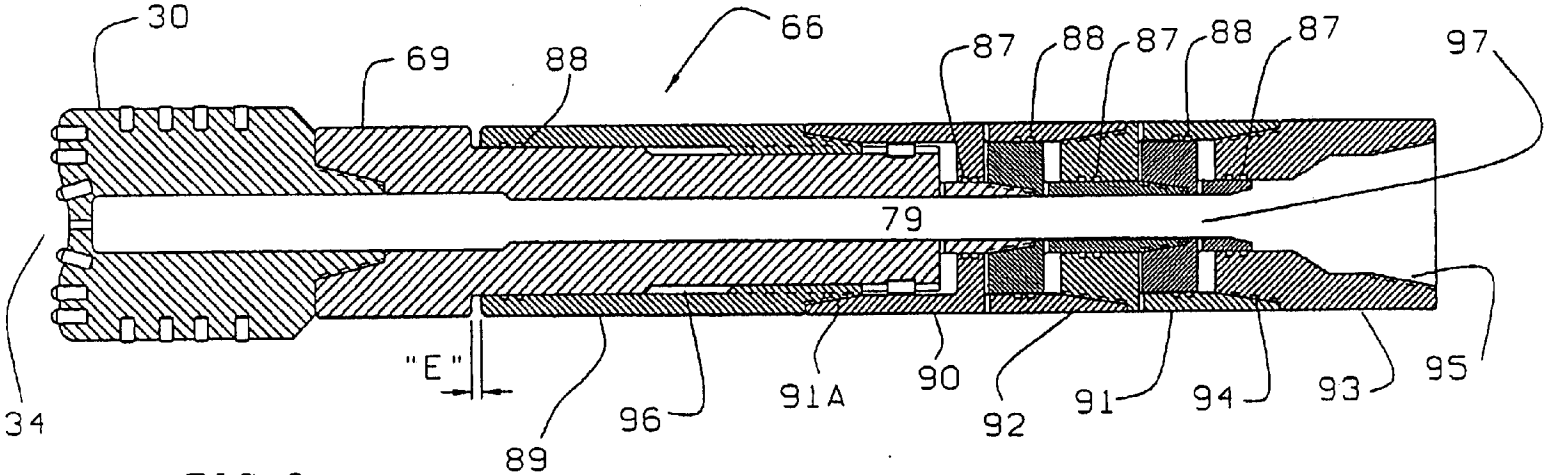
FIG. 8 is a longitudinal sectional view of the down hole telescopic tool of FIG. 7 shown in its "open" position.
Figure 9:
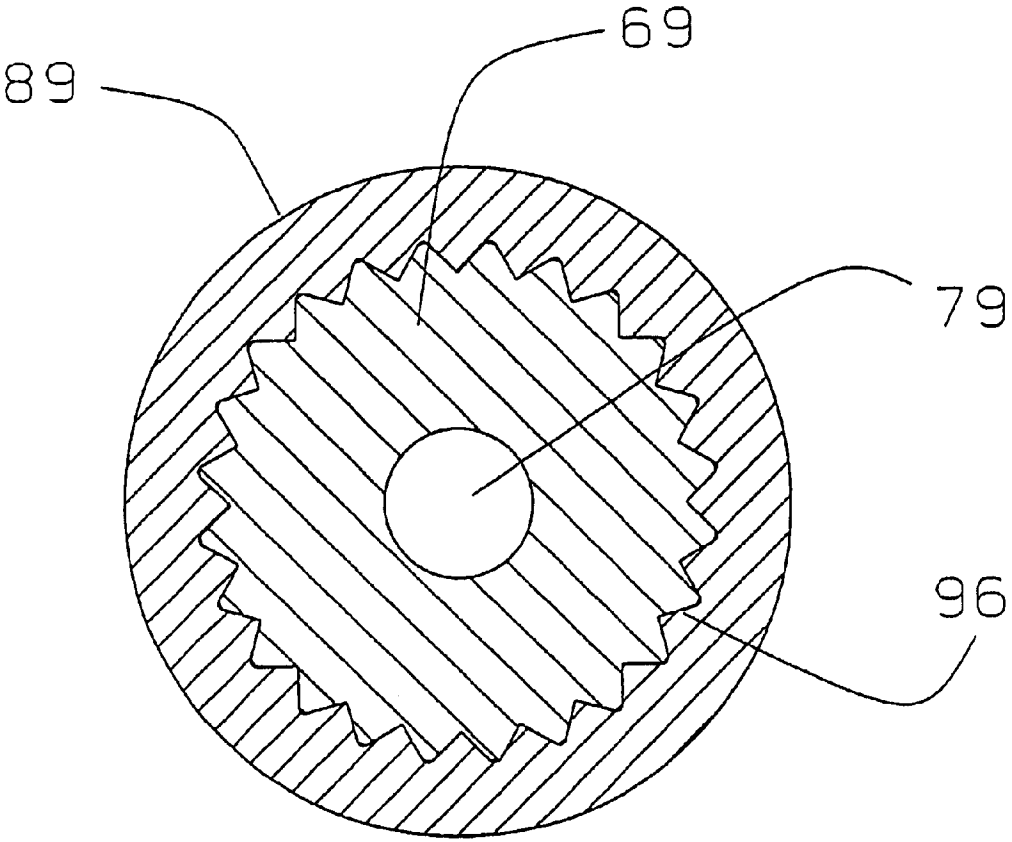
FIG. 9 is a cross sectional view through a splined part of the telescopic tool of FIG. 8.

FIGS. 7 and 8 show a longitudinal sectional view of a multiple piston telescopic tool 66 in normal and extended positions respectively. Tool 66 is coupled to a bottom end of a section of one drill collar 28 via a coupling which, for example comprises a conventional threaded coupling 95. Tool 66 includes a ram 69 which is coupled to drill bit 30 at a connection 70. Connection 70 may be a conventional threaded coupling. Ram 69 bears splines 96 and is received within a female-splined member 89 as shown in FIGS. 8 and 9. Splines 96 provide a torque coupling between female splined member 89 and ram 69. Ram 69 can therefore slide longitudinally within the body of tool 66 without interrupting the transmission of rotational motion to drill bit 30. A top end of ram 69 is coupled to a pair of pistons 72, 74. Ram 69 and pistons 72 and 74 can move longitudinally in tool 66 as a unit. The arrival at tool 66 of a pressure pulse propagating through the drilling mud in bore 79 forces pistons 72 and 74 downwardly. This, in turn, causes ram 69 to move from the normal position shown in FIG. 7 to the extended position shown in FIG. 8.

In the illustrated tool 66 each of pistons 72 and 74 is slidably disposed within a housing. Piston 72 is disposed within housing 90. Piston 74 is disposed within a housing 91. Housing 90 is coupled to housing 91 by a suitable coupling, such as threaded coupling 92. Housing 91 is coupled to a top sub 93 at a suitable coupling, such as threaded coupling 94. Housing 90 is coupled to female-splined member 89 which receives ram 69 by a suitable coupling such as a threaded coupling 91A.

Each piston is located between a pair of cavities. Cavities 77 and 78 are upwardly adjacent to pistons 72 and 74 respectively. Cavities 77 and 78 are each in fluid communication with bore 79. In the illustrated embodiment apertures 81 and 82 are provided for this purpose. Cavities 83 and 84 are downwardly adjacent to pistons 72 and 74 respectively. Cavities 83 and 84 are each in fluid communication with the well bore 31 outside of tool 66. In the illustrated embodiment apertures 85 and 86 are provided for this purpose.

A cavity 76 is also defined between the upper end of ram 69 and housing 90. This cavity is in fluid communication with bore 79, for example by way of apertures 80. Shaft seals 87 and piston seals 88 seal cavities 76, 77 and 78.

The number of pistons may be varied. One or more pistons may be used. Preferably two or more pistons are provided. An additional piston may be added simply by coupling a piston like piston 72 between pistons 72 and 74 and a housing like housing 91 between housings 91 and 92.

FIG. 7 shows multiple piston telescopic tool 66 when no acoustic pressure pulse is present and tool 66 is in its closed position. When a pressure pulse propagating down bore 79 reaches area 97, the pressure of drilling mud in area 97 is suddenly increased. This causes drilling mud to be forced into cavities 76, 77 and 78 via apertures 80, 81 and 82 respectively. The increased pressure within cavities 76, 77 and 78 acting on projected piston areas results in an axial force on ram 69. This force drives ram 69, and drill bit 30, into the bottom of hole surface 34. For example, a pressure pulse of 1,500 psi acting on total area of 80 $in^2$ will produce an axial force of 120,000 lbs. This axial force will cause drill bit 30 to be thrust against the bottom of hole 34, while reaction to this axial force will lift the part of the drill string situated above multiple piston telescopic tool 66. Relative telescopic movement is indicated by "E" on FIG. 8. When the pressure pulse has passed the weight of the drill string above multiple piston telescopic tool 66 will cause tool 66 to collapse back into its normal position and thereby closing gap E. The dropping drill string will also deliver additional impact forces applied to drill bit 30.

Figure 10:
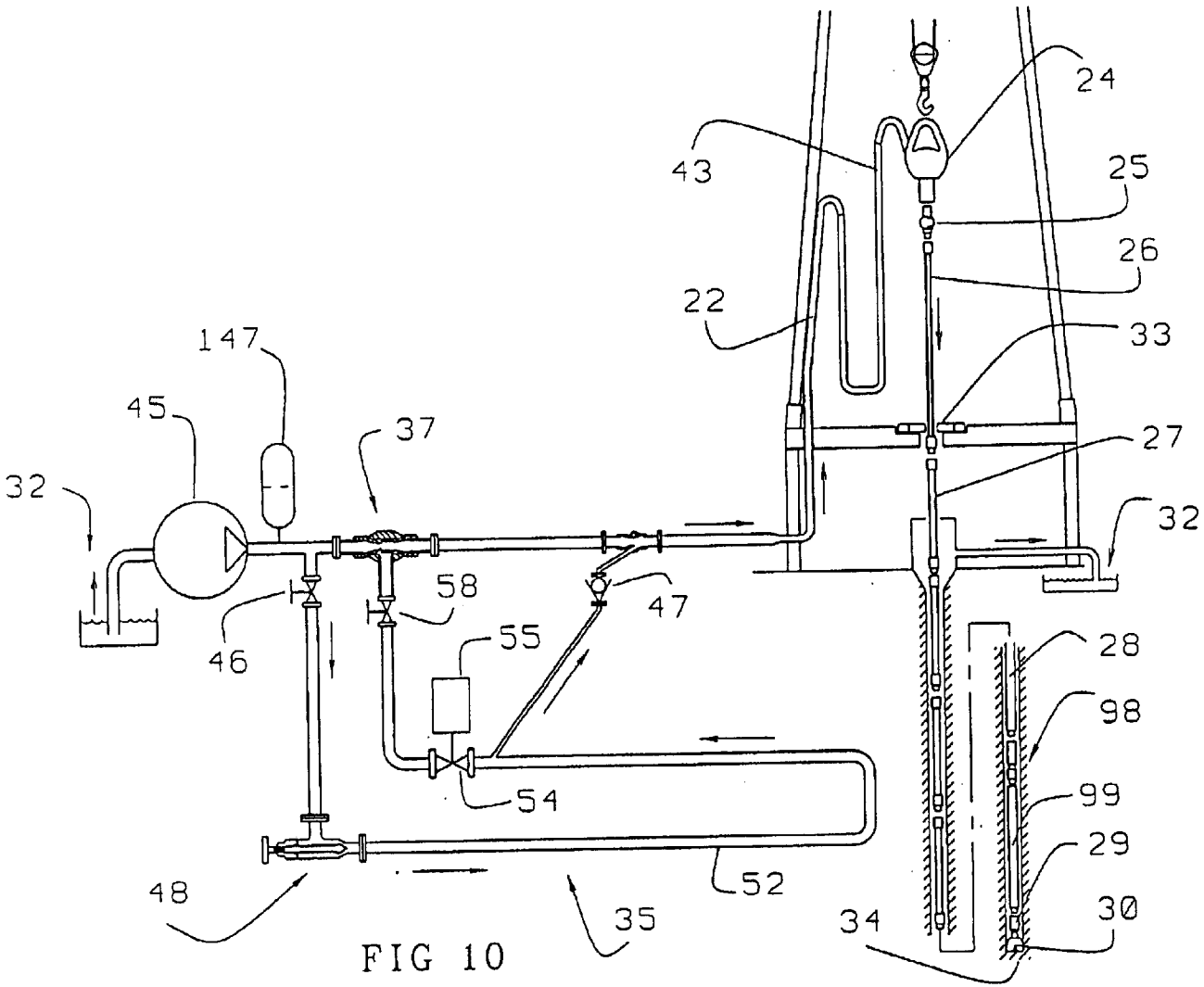
FIG. 10 is a schematic view of a drilling apparatus including a surface acoustic pulse generator and a multiple piston telescopic (MPT) tool in the drill string above one or a few drill collars.

FIG. 10 is a schematic view of a drilling rig according to an alternative embodiment of this invention. In the apparatus of FIG. 10, high pressure pulses generated at SAP generator 35 are conveyed down the drill string through a multiple piston telescopic tool 98, mounted above one or more lower drill collars 99, and attendant bit sub 29 and drill bit 30. This embodiment provides for vigorous axial vibration of the bottom part of the drill string, allowing in some instances to drill percussively without need for a classical drill bit 30.

Figure 11:
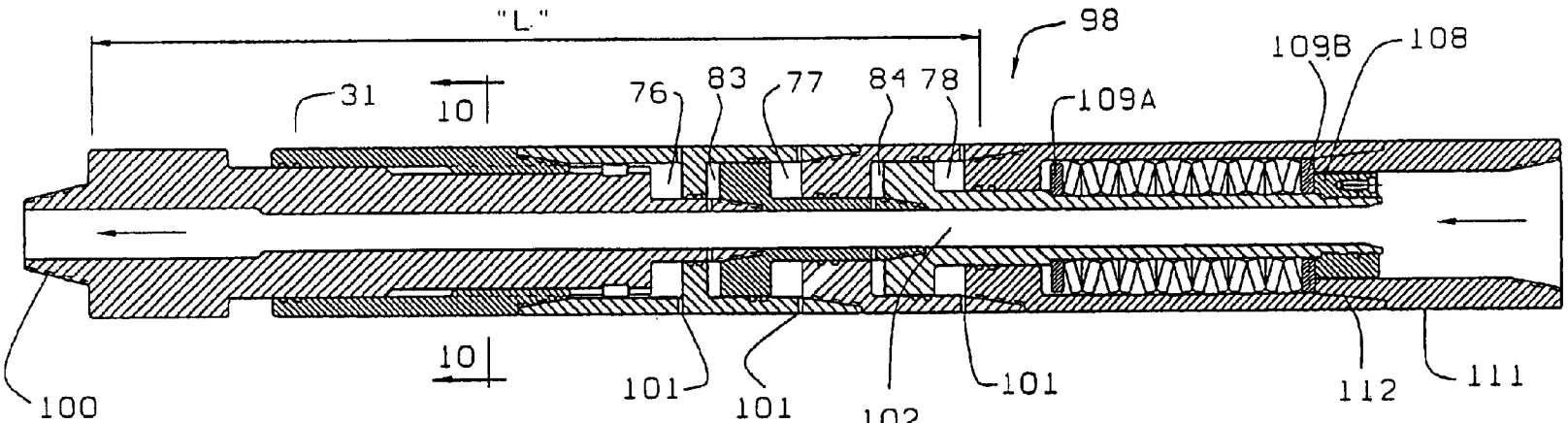
FIG. 11 is a longitudinal sectional view of the MPT tool in a first position wherein the weight of the portion of the drill string below the tool is supported by a set of springs.
Figure 12:
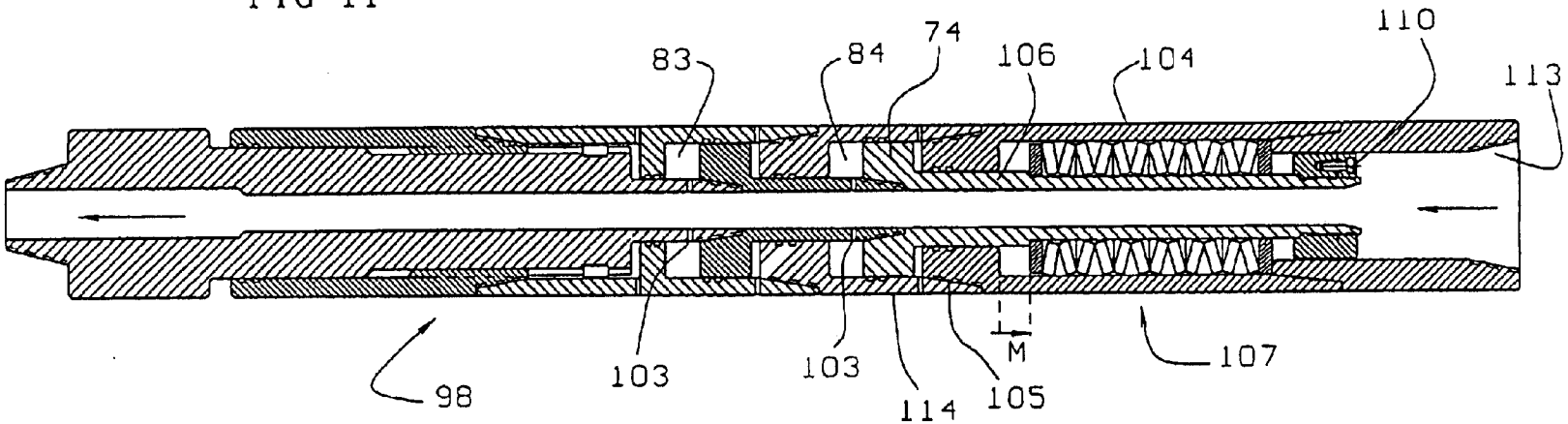
FIG. 12 is a longitudinal sectional view of the MPT tool of FIG. 11 in a second position which occurs when a pressure pulse lifts the portion of the drill string below the MPT tool; and, FIG. 13 is a schematic view of a tool which may be used to impart vibration to a drill bit.

FIGS. 11 and 12 show a longitudinal sectional view of a multiple piston telescopic tool 98. A bottom part of tool 98, identified by "L", is similar to the multiple piston telescopic tool 66 shown in FIGS. 7 and 8, except that:

- bottom part L is adapted to be coupled to a top section of a lower drill collar 99. In the illustrated embodiment, ram 69A in bottom part L comprises a male thread 100, which can be screwed to drill collar 99.
- cavities 76, 77 and 78 are in fluid communication with outside well bore 31 instead of bore 79. In the illustrated embodiment, holes 101 are provided for this purpose.
- cavities 83 and 84 are in fluid communication with inside bore 79 instead of outside well bore 31. In the illustrated embodiment, holes 103 are provided for this purpose.

A top part of tool 98 comprises a spring housing 104, which is coupled to a third piston housing 114 via threaded connection 105. Piston 74 comprises a piston mandrel extension 106 which extends into spring housing 104. A spring is connected between spring housing 104 and mandrel extension 106. The spring has a very large spring constant. The spring is compressed whenever the piston mandrel extension 106 moves longitudinally upwardly or downwardly inside spring housing 104. In the illustrated embodiment, a stack of disk springs 107 is on mandrel extension 106 between washers 109A and 109B. Washer 109A abuts a step in the outside of mandrel extension 106. Washer 109B abuts the bottom of a top sub 111 which is coupled to spring housing 104 via threaded connection 112.

Ram 69A and other parts of the drill string below tool 98 are supported by a safety nut 108. Safety nut 108 is locked in place by a screw 110. Tool 98 is coupled to the drill string at its top end via a threaded connection 113.

Figure 13:
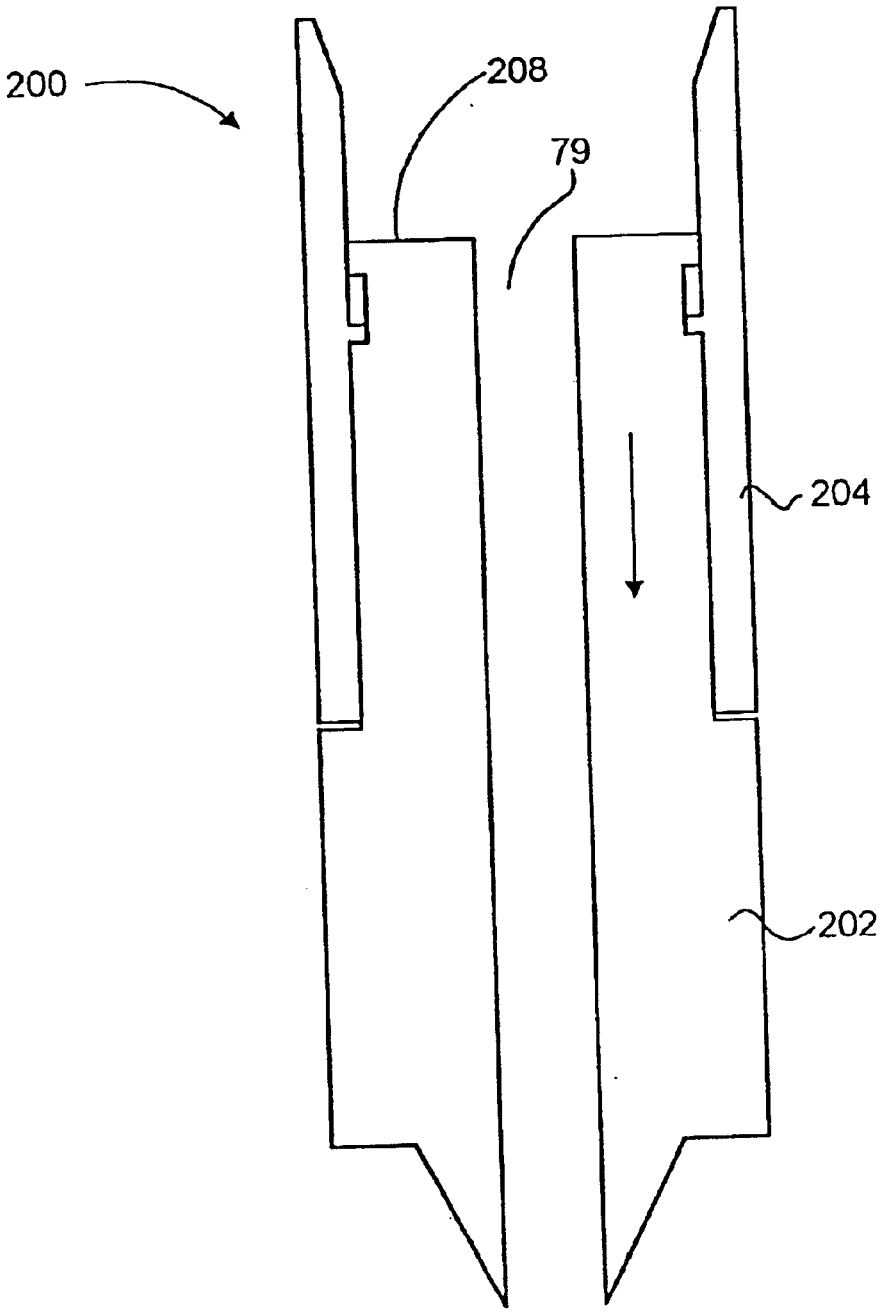

FIG. 12 shows multiple piston telescopic tool 98 when the pressure within bore 102 is at its low or zero value. FIG. 13 shows multiple piston telescopic tool 98 when a high pressure pulse has propagated down the drill string and is passing through bore 102 of tool 98. The pressure pulse increases the pressure of drilling mud in bore 102 and causes drilling mud to be forced into cavities 83 and 84. This causes a force to act on pistons 72 and 74 so as to drive the pistons upwardly. When the pistons move upwardly the portion of the drill string located below tool 98 is also lifted upwardly and spring 107 is compressed. After the effect of the pressure pulse has dissipated, loaded stack of disk springs 107 will dynamically return bottom part L of tool 98 to its initial position, thus resulting in a significant percussive blow to bottom hole 34.

For example, a pressure pulse of 1,500 psi multiplied by a combined piston area of 60 $in^2$ will produce an axial lifting force of 90,000 lbs. In a typical drilling apparatus the weight of lower drill collars 99, and other elements (such as drill bit 30) located below multiple piston telescopic tool 98, is approximately 3,000–6,000 lbs. Spring 107 will therefore elastically absorb the resultant axial force and return bottom end of the drill string with such a force so as to produce extreme percussive blows to bottom hole 34. These percussive blows can enhance drilling penetration rates, particularly when the formation being drilled is hard.

FIG. 13 illustrates schematically another simple tool which may be used to impart vibration to a drill bit. Tool 200 comprises a splined ram 202 which is slidably disposed within a female-splined part 204. Ram 202 is coupled to a drill bit. Female splined part 204 is coupled to the upper portion of the drill string. A diameter of bore 79 is reduced at or in ram 202. Ram 202 thereby presents an upwardly facing surface 208. When a pressure pulse propagating down bore 79 increases the pressure acting on surface 208 ram 202 (and the drill bit) are hammered downwardly.

As will be apparent to those skilled in the art in the light of the foregoing disclosure, many alterations and modifications are possible in the practice of this invention without departing from the spirit or scope thereof. For example:

While the foregoing description details the generation of high intensity pulses by interrupting the flow of the drilling mud pressurized by mud pump 45 a separate pump could be used to provide flowing drilling mud for use in generating high pressure pulses.

While the flowing fluid medium which is used to generate high pressure pulses is described above as being drilling mud, a separate circuit in which high pressure pulses are developed by creating water hammers in a different fluid medium, such as water, could be used to generate high pressure pulses which are then coupled into the drilling mud being pumped down drill string.

Other techniques could be used for generating high pressure pulses which are propagated down through the drill string. For example, a piston capable of being very suddenly accelerated could be located to transmit high intensity pulses into the flowing drilling mud 57. The piston could be on a very high energy electromechanical transducer, for example.

Other types of tool such as drilling jars may be constructed so as to be operable by high intensity pulses propagated from the surface according to the invention.

Accordingly, the scope of the invention is to be construed in accordance with the substance defined by the following claims.

What is claimed is:

1. A method for underground drilling, the method comprising:

a) generating high intensity reduced pressure pulses at the surface of an area to be drilled;

b) coupling the high intensity reduced pressure pulses into drilling mud being pumped into a drill string;

c) allowing the high intensity reduced pressure pulses to propagate down the drill string to an underground location; and, d) allowing the high intensity reduced pressure pulses to do work at the underground location.

2. The method of claim 1 wherein the work comprises causing a flow of drilling fluid through nozzles in a drill bit at the bottom of the drill string to fluctuate.

3. The method of claim 1 wherein the work comprises operating a down hole tool.

4. The method of claim 3 wherein operating the downhole tool comprises forcing a portion of the drill string which includes the drill bit suddenly downwardly.

5. The method of claim 4 wherein generating the high intensity reduced pressure pulses comprises causing drilling mud to flow in a conduit and suddenly and periodically interrupting the flow of drilling mud in the conduit.

6. The method of claim 4 practised on a drilling rig having a drill string suspended from a swivel and a flexible hose carrying drilling mud into the swivel for passage down the drill string wherein coupling the high intensity reduced pressure pulses into drilling mud being pumped into the drill string comprises coupling the high intensity reduced pressure pulses into drilling mud upstream from the flexible hose.

7. The method of claim 4 practised on a drilling rig having a drill string suspended from a swivel and a flexible hose carrying drilling mud into the swivel for passage down the drill string wherein coupling the high intensity reduced pressure pulses into drilling mud being pumped into the drill string comprises coupling the high intensity reduced pressure pulses into drilling mud downstream from the swivel.

8. The method of claim 3 wherein operating the downhole tool comprises lifting a portion of the drill string which includes the drill bit upwardly and compressing a spring.

9. The method of claim 1 wherein generating the high intensity reduced pressure pulses comprises causing drilling mud to flow in a conduit and suddenly and periodically interrupting the flow of drilling mud in the conduit.

10. The method of claim 9 wherein causing drilling mud to flow in a conduit comprises diverting a portion of a main flow of drilling mud from a mud pump to the drill string into the conduit.

11. The method of claim 10 comprising returning mud which has flowed through the conduit to a mud tank.

12. The method of claim 1 practised on a drilling rig having a drill string suspended from a swivel and a flexible hose carrying drilling mud into the swivel for passage down the drill string wherein coupling the high intensity reduced pressure pulses into drilling mud being pumped into the drill string comprises coupling the high intensity reduced pressure pulses into drilling mud upstream from the flexible hose.

13. The method of claim 1 practised on a drilling rig having a drill string suspended from a swivel and a flexible hose carrying drilling mud into the swivel for passage down the drill string wherein coupling the high intensity reduced pressure pulses into drilling mud being pumped into the drill string comprises coupling the high intensity reduced pressure pulses into drilling mud downstream from the swivel.

14. A method for underground drilling, the method comprising:

a) generating high intensity pressure pulses at the surface of an area to be drilled;

b) coupling the high intensity pressure pulses into drilling mud being pumped into a drill string;

c) allowing the high intensity pressure pulses to propagate down the drill string to an underground location; and, d) allowing the high intensity pressure pulses to operate a downhole tool at the underground location, wherein operating the downhole tool comprises lifting a portion of the drill string which includes the drill bit upwardly and compressing a spring.

15. The method of claim 14 wherein generating the high intensity pressure pulses comprises causing drilling mud to flow in a conduit and suddenly and periodically interrupting the flow of drilling mud in the conduit.

16. The method of claim 15 wherein causing drilling mud to flow in a conduit comprises diverting a portion of a main flow of drilling mud from a mud pump to the drill string into the conduit, the method comprising providing a point at which a hydrostatic pressure of drilling mud flowing toward a drill string in a main conduit is reduced and introducing mud which has flowed through the conduit into the main conduit at the point of reduced pressure.

17. The method of claim 16 wherein providing a point at which a hydrostatic pressure of drilling mud flowing toward a drill string in a main conduit is reduced comprises providing a jet pump and causing drilling mud flowing in the main conduit to pass through the jet pump.

18. The method of claim 14 practised on a drilling rig having a drill string suspended from a swivel and a flexible hose carrying drilling mud into the swivel for passage down the drill string wherein coupling the high intensity pressure pulses into drilling mud being pumped into the drill string comprises coupling the high intensity pressure pulses into drilling mud upstream from the flexible hose.

19. The method of claim 14 practised on a drilling rig having a drill string suspended from a swivel and a flexible hose carrying drilling mud into the swivel for passage down the drill string wherein coupling the high intensity pressure pulses into drilling mud being pumped into the drill string comprises coupling the high intensity pressure pulses into drilling mud downstream from the swivel.

20. Underground drilling apparatus comprising:

a) a drill string;

b) a mud pump;

c) a main conduit carrying mud pumped by the mud pump toward the drill string;

d) pulse generator means located at the surface for generating high intensity reduced pressure pulses;

e) pulse transmission means for coupling high intensity reduced pressure pulses generated by the pulse generator means into mud being pumped toward the drill string.

21. The apparatus of claim 20 wherein the drill string comprises a downhole tool.

22. The apparatus of claim 21 wherein the downhole tool comprises one or more pistons.

23. The apparatus of claim 21 wherein the downhole tool is a drilling jar.

24. A method for underground drilling, the method comprising:

a) generating high intensity pressure pulses at the surface of an area to be drilled;

b) coupling the high intensity pressure pulses into drilling mud being pumped into a drill string;

c) allowing the high intensity pressure pulses to propagate down the drill string to an underground location; and, d) allowing the high intensity pressure pulses to operate a downhole tool at the underground location, wherein operating the downhole tool comprises moving a portion of the drill string below the downhole tool which includes the drill bit relative to a portion of the drill string above the downhole tool.

25. The method of claim 24 wherein moving a portion of the drill string below the downhole tool which includes the drill bit relative to a portion of the drill string above the downhole tool comprises lifting the portion of the drill string below the downhole tool which includes the drill bit.

* * * * *